US009207640B2

(12) United States Patent
Stranczl et al.

(10) Patent No.: US 9,207,640 B2
(45) Date of Patent: Dec. 8, 2015

(54) FLEXIBLE ESCAPE MECHANISM WITH NO PALLET LEVER

(71) Applicant: Nivarox-FAR S.A., Le Locle (CH)

(72) Inventors: Marc Stranczl, Nyon (CH); Thierry Hessler, St-Aubin (CH); Andres Cabezas Jurin, Yverdon (CH); Davide Sarchi, Renens (CH)

(73) Assignee: Nivarox-FAR S.A., Le Locle (CH)

( * ) Notice: Subject to any disclaimer, the term of this patent is extended or adjusted under 35 U.S.C. 154(b) by 0 days.

(21) Appl. No.: 14/384,261

(22) PCT Filed: Mar. 27, 2013

(86) PCT No.: PCT/EP2013/056579
§ 371 (c)(1),
(2) Date: Sep. 10, 2014

(87) PCT Pub. No.: WO2013/144237
PCT Pub. Date: Oct. 3, 2013

(65) Prior Publication Data

US 2015/0103636 A1 Apr. 16, 2015

(30) Foreign Application Priority Data

Mar. 29, 2012 (EP) ..... 12162030

(51) Int. Cl.
*G04B 15/14* (2006.01)
*G04B 15/00* (2006.01)
(Continued)

(52) U.S. Cl.
CPC ..... *G04B 15/14* (2013.01); *G04B 15/00* (2013.01); *G04B 15/06* (2013.01); *G04B 15/08* (2013.01); *G04B 15/12* (2013.01)

(58) Field of Classification Search
CPC ..... G04B 15/00; G04B 15/06; G04B 15/08; G04B 15/12; G04B 15/14
See application file for complete search history.

(56) References Cited

U.S. PATENT DOCUMENTS 3,949,547 A 4/1976 Schneiter
2010/0149926 A1* 6/2010 Colpo et al. ..... 368/127
(Continued)

FOREIGN PATENT DOCUMENTS

CH 60813 7/1912
EP 1 967 919 9/2008
(Continued)

OTHER PUBLICATIONS

International Search Report Issued Jun. 5, 2013 in PCT/EP13/056579 Filed Mar. 27, 2013.

*Primary Examiner* — Amy Cohen Johnson
*Assistant Examiner* — Matthew Powell
(74) *Attorney, Agent, or Firm* — Oblon, McClelland, Maier & Neustadt, L.L.P.

(57) ABSTRACT

An escape mechanism including a flexible single-piece mechanism for transmission of impulses between an impulse pin of a balance, and teeth of an escape wheel. Each tooth includes a lever with a pin that can be actuated by a lifting piece, a low level of the wheel carrying the pins on a same level as stop members of a plate, and a high level carrying the lifting pieces. The impulse pin pivots a lever opposite thereto, either to cause the pin to cooperate in abutment with the second stop member, or to move the lifting piece thereof opposite the first stop member and to cause the pin to bypass the second stop member, allowing the wheel to rotate to a next tooth.

6 Claims, 3 Drawing Sheets

(51) Int. Cl.

| | |
|---|---|
| ***G04B 15/06*** | (2006.01) |
| ***G04B 15/08*** | (2006.01) |
| ***G04B 15/12*** | (2006.01) |

(56) References Cited

U.S. PATENT DOCUMENTS

| | | | | |
|---|---|---|---|---|
| 2010/0214881 | A1* | 8/2010 | Chiuve et al. | 368/131 |
| 2011/0310709 | A1* | 12/2011 | Vaucher et al. | 368/132 |
| 2012/0113764 | A1 | 5/2012 | Queval | |
| 2013/0070570 | A1 | 3/2013 | Colpo et al. | |

FOREIGN PATENT DOCUMENTS

| | | |
|---|---|---|
| EP | 2 037 335 | 3/2009 |
| EP | 2 105 806 | 9/2009 |
| EP | 2 221 677 | 8/2010 |
| EP | 2 450 755 | 5/2012 |
| FR | 675 597 | 2/1930 |
| FR | 2 250 145 | 5/1975 |
| WO | 2011 120180 | 10/2011 |

* cited by examiner

FLEXIBLE ESCAPE MECHANISM WITH NO PALLET LEVER

FIELD OF THE INVENTION

The invention concerns an escape mechanism for a timepiece movement or timepiece including at least one balance and at least one escape wheel.

The invention also concerns a timepiece movement including a fixed structure and at least one mechanism of this type.

The invention also concerns a timepiece including a fixed structure and at least one mechanism of this type, and/or at least one timepiece movement of this type.

The invention concerns the field of timepiece mechanisms, and more specifically escape mechanisms.

BACKGROUND OF THE INVENTION

Watchmaking performance requires high precision movements, with minimum space requirements, and a reduced number of components, in order to control production, assembly and adjustment costs. LIGA or DRIE technologies can produce flexible, precise components, and challenge conventional architectures, which are characterized by a high number of components and complex adjustments.

WO Patent No 2011/120180 A1 in the name of Rolex SA discloses a pallet type brake lever, with two arms, each provided with a pallet-stone for engaging with the same toothed wheel, with two elastic arms connecting the brake lever to a frame which enables it to pivot, and a third elastic element substantially forming a bistable system.

EP Patent No 2037335 A2 in the name of Enzler & Von Gunten, discloses a single piece Swiss lever, with two arms each provided with a pallet-stone, and including arms formed by flexible strips connected to a structure and defining a false pivot.

EP Patent No 2450755 A1 in the name of Nivarox discloses an escape wheel for a timepiece mechanism, including a plurality of toothed wheels, which are coaxial and pivot synchronously about a pivot axis and include at least a first toothed impulse wheel in a first impulse plane and at least a second toothed release wheel in a second stopping plane, parallel to or merged with the first impulse plane. The second toothed release wheel includes at least one moveable assembly which includes, on the one hand, at least one release tooth that is moveable radially relative to the pivot axis and returned to a position of equilibrium by a first return means, and on the other hand, at least one locking tooth returned in a first radial direction towards a stop position by a second return means. The release tooth includes a drive means arranged, when the release tooth moves in a second radial direction opposite to the first radial direction, to cooperate with a complementary drive means comprised in the locking tooth in order to drive the locking tooth in the second radial direction. When the release tooth moves in the first radial direction, the drive means is arranged to move at a distance from the complementary drive means without driving the locking tooth.

EP Patent No 2105806 A1 in the name of Girard Perregaux SA discloses a deformable frame defining two orthogonal axes, including a strip spring buckled in its largest dimension and arranged to restore energy when there are changes in the shape of the bistable strip.

EP Patent No 2 221677 A1 in the name of Rolex SA discloses a detent escapement with a lever pivoting against a spring, which pushes a stop element of said lever towards the escape wheel; the lever carries a release element which cooperates with a release finger carried by a roller whose position is moveable relative to the balance roller under the effect of variations in the velocity of the balance.

CH Patent No 60813 A in the name of Shoal discloses a lever escapement whose escape wheel includes, on both sides of the flange thereof, alternating teeth cooperating with pallet-stones mounted opposite to and facing each other.

EP Patent No 1967919 A1 in the name of ETA SA discloses an escapement with tangential impulses comprising a moveable, ring-shaped frame comprising palette stones arranged to cooperate with the teeth of a moveable escapement located inside the ring.

SUMMARY OF THE INVENTION

The invention proposes to overcome the limitations of known architectures, by proposing compact mechanisms having a small thickness and which are economical to produce.

The invention therefore concerns an escape mechanism for a timepiece movement or timepiece comprising at least one balance and at least one escape wheel, characterized in that the transmission of impulses between said at least one balance and said at least one escape wheel is achieved by a flexible single-piece mechanism including at least one feeler spindle cooperating with said at least one escape wheel or respectively at least one balance, and in that said flexible single-piece mechanism is connected by at least one flexible strip to a fixed structure of said timepiece, or respectively to said at least one escape wheel.

The invention also concerns a timepiece movement including a fixed structure and at least one mechanism of this type.

The invention also concerns a timepiece including a fixed structure and at least one mechanism of this type, and/or at least one timepiece movement of this type.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
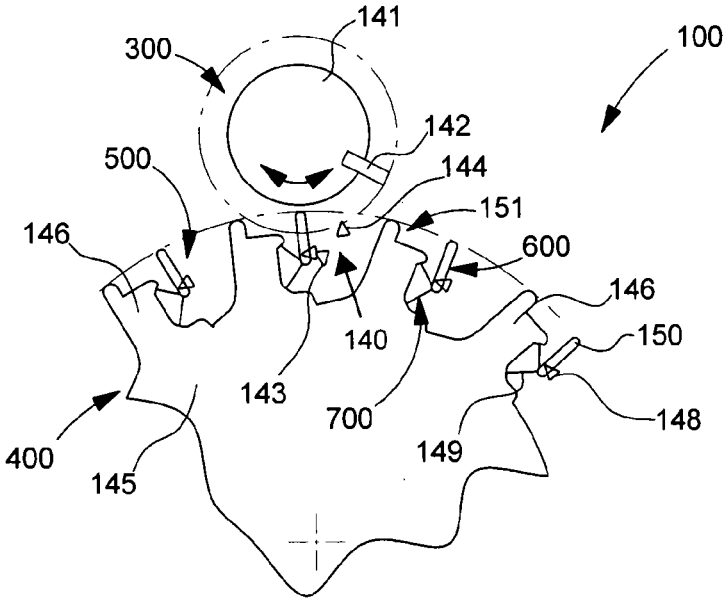
FIGS. 1, 1A, 1B, 2, 2A, and 2B illustrate an escapement with no pallet lever according to the invention.

Numerous timepiece mechanisms may be made, with a reduced number of components, and preferably using components made of silicon, or by a LIGA or DRIE method, comprising flexible areas.

These flexible areas may be used to form guide members, particularly pivot guides, and/or to form elastic return means.

"Flexible guide members" in the following description means a linear or rotating guide member comprising one or more flexible strips. These guide members have numerous advantages, of which the following, in particular, may be cited: precision, no friction, no hysteresis, no wear, no requirement for lubrication, no seizing, monolithic manufacturing. The most common limitations are: limitation of movements, low return force or torque density, occasionally complex kinematics, limitation on the load carried.

Flexible guide members may be modified to obtain zero rigidity or to have a bistable state in the case of a component that works by buckling under the action of forces exerted on both sides of a middle direction, on either side of which the component may occupy two different stable states.

In a particularly advantageous manner, the invention is applicable to an escape mechanism 100 for a timepiece movement 900 or timepiece 1000 including at least one balance 300 and at least one escape wheel 400.

According to the invention, the transmission of impulses between said at least one balance 300 and said at least one escape wheel 400 is achieved via a flexible single-piece mechanism 500. This flexible single-piece mechanism 500 includes at least one feeler spindle 600 cooperating with said at least one escape wheel 400 or respectively said at least one balance 300. Flexible single-piece mechanism 500 is connected by at least one flexible strip 700, or preferably by a plurality of flexible strips forming elastic return means, to a fixed structure 800 of said timepiece 1000, or respectively to said at least one escape wheel 400.

Figure 2:
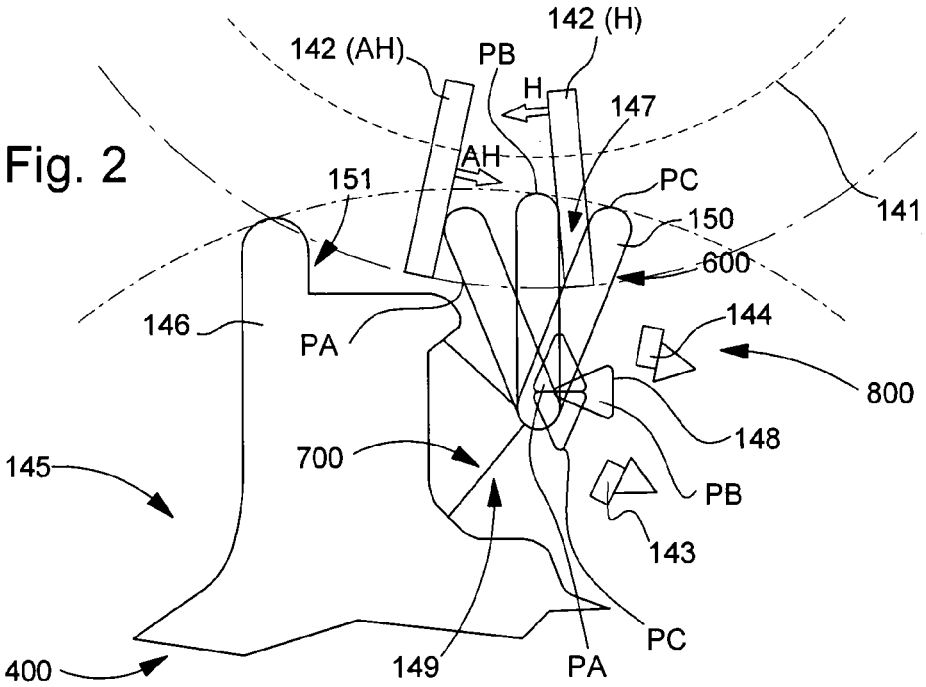
Figure 3:
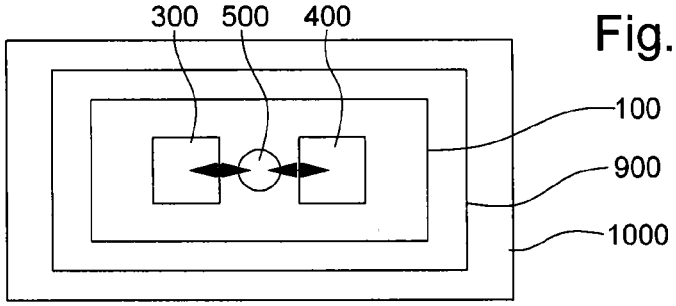
FIG. 3 shows, in the form of block diagrams, a timepiece with a movement including a mechanism of this type.
Figure 1A:
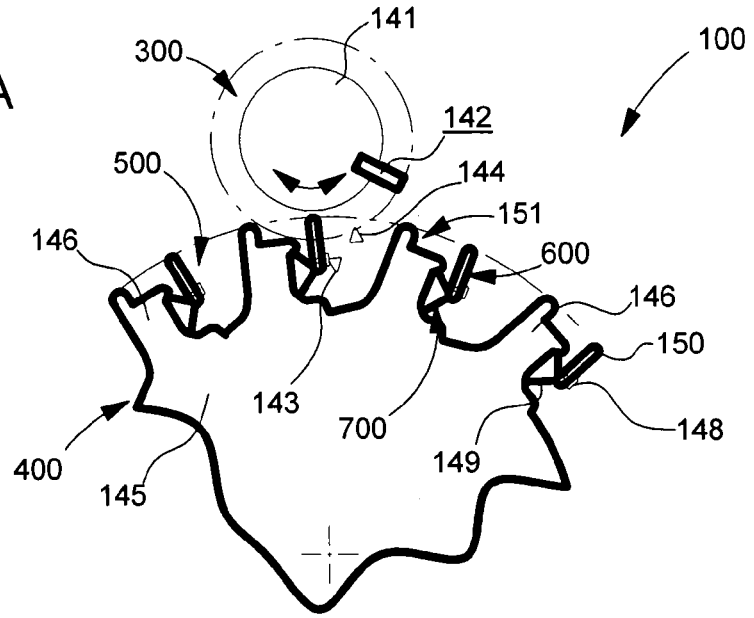
Figure 2A:
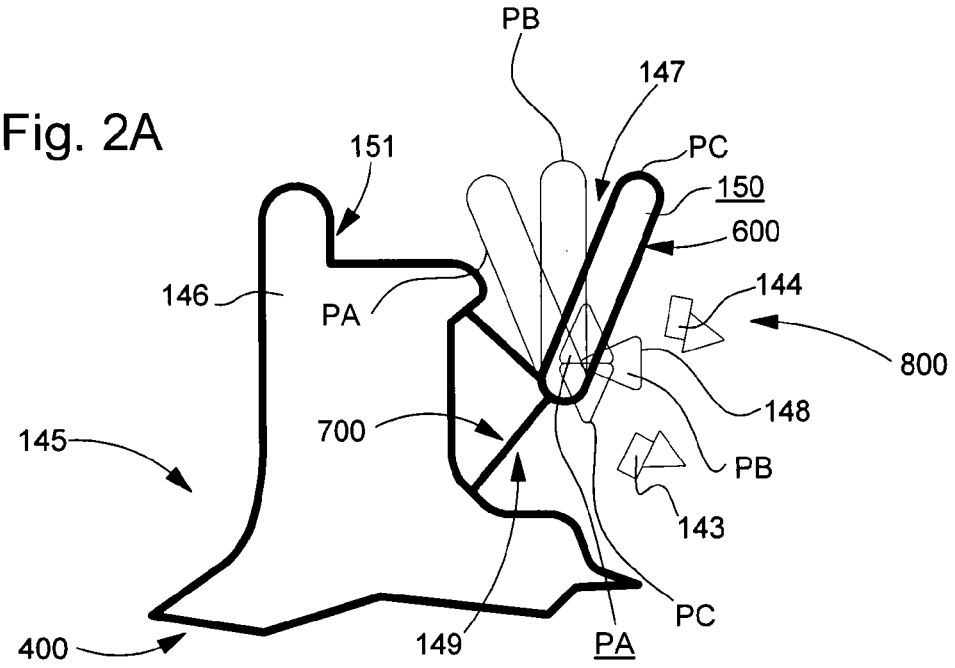
Figure 1B:
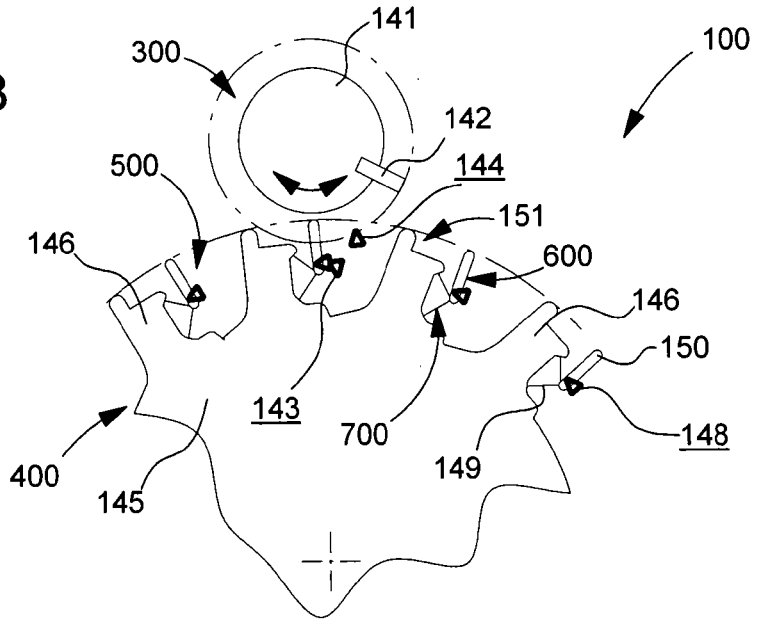
Figure 2B:
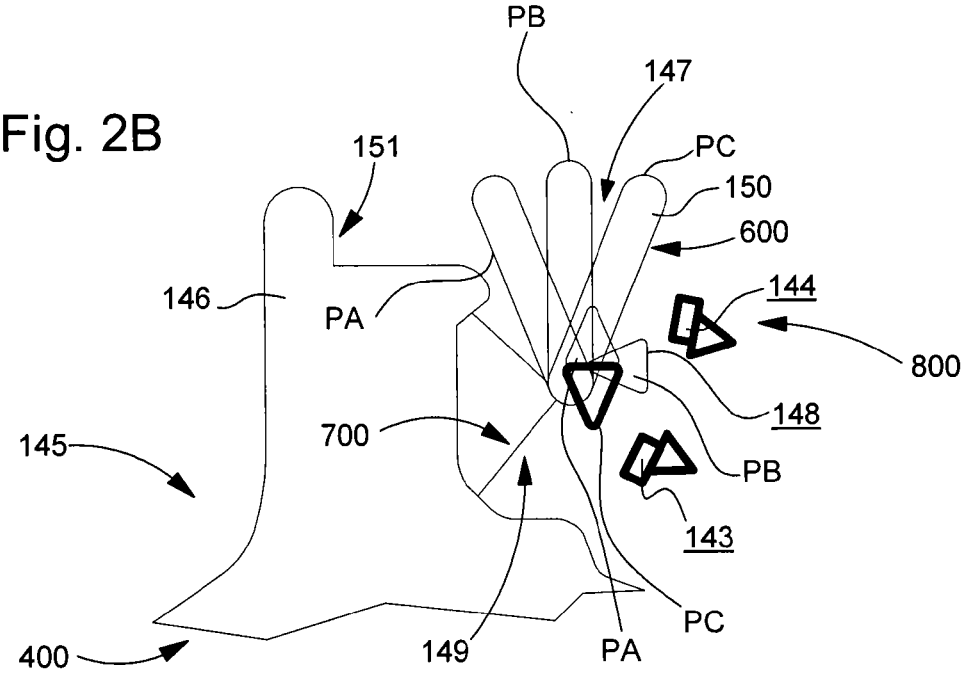

FIGS. 1 and 2 illustrate an escapement with no pallet lever. Balance 141 includes a roller with an impulse pin 142. The plate 140 includes two pins/stop members 143 and 144. An escape wheel 145 includes a plurality of teeth 146. Each tooth 146 forms an intermittent blocking mechanism, and includes a flexible lever 147: each lever flexible 147 includes a lever pin 148 guided by flexible strips 149. This lever pin 148 can be actuated by a small lifting piece 150. Each tooth 146 also includes an impulse plane 151. The escape wheel mechanism is on two levels: a low level carries lever pins 148, and is the level on which the plate pins/stop members 143 and 144 are arranged, whereas a high level carries the structure of escape wheel 145 and lifting pieces 150. FIGS. 1A and 2A show the elements of the high level in bold and FIGS. 1B and 2B show the elements of the low level in bold. The operation of the mechanism is explained with reference to one tooth 146 of escape wheel 145 just after an impulse, with balance 141 starting a time movement. When balance 141 rotates clockwise, impulse pin 142 pivots flexible lever 147, which changes from position PB to position PA in FIG. 2, and is released from the first plate stop member 143. Escape wheel 146 advances through a very small angle until lever pin 148 of flexible lever 147 abuts against the second plate stop member 144.

When balance 141 pivots anti-clockwise, impulse pin 142 pivots flexible lever 147 which is opposite thereto, bringing lifting piece 150 into position PC, and lever pin 148 bypasses the second plate stop member 144. Escape wheel 145 rotates to the next tooth. In this movement, the impulse plane 151 of escape wheel 145 imparts an impulse to impulse pin 142.

In a particular variant, a ruby lifting piece is dedicated to the impulse. The special shape of pins/stop members 143 and 144 integral with the plate prevents tripping.

The invention also concerns a timepiece movement 900 including at least one flexible mechanism of this type, and in particular including a fixed structure 800 and at least one mechanism 100 of this type.

The invention also concerns a timepiece 1000, in particular a watch, including at least one timepiece movement 900 of this type, and/or at least one of the flexible mechanisms described above, in particular including a fixed structure 800 and at least one mechanism 100 of this type.

The invention claimed is:

1. An escape mechanism comprising:

a plate;

a balance; and an escape wheel including flexible levers for transmission of impulses between an impulse pin of the balance, and teeth of the escape wheel;

wherein the escape mechanism is an escape mechanism with no pallet lever, and each tooth includes a flexible lever of the flexible levers, the flexible lever including a lifting piece to actuate a lever pin guided by first flexible strips, a low level of the wheel carrying the lever pins on a same level as a first stop member and a second stop member, comprised in said plate and said lever pins being arranged for cooperating with said first stop members and said second stop members, and a high level of the wheel carrying the lifting pieces, and the impulse pin being arranged to pivot the flexible lever that faces the impulse pin, in a first pivoting direction of the balance to cause the lever pin to cooperate in abutment with the second stop member by stopping the escape wheel, or in a second pivoting direction of the balance opposite to the first pivoting direction to move the lifting piece of the flexible lever opposite the first stop member and to cause the lever pin to bypass the second stop member allowing the wheel to rotate to a next tooth.

2. The escape mechanism according to claim 1, wherein each of the flexible levers is connected by at least one second flexible strip to the plate, each of the lever pins is guided by the first flexible strips, each tooth includes an impulse plane, so that, when the balance starts a time movement just after an impulse, the impulse pin pivots the corresponding flexible lever, which is released from the first stop member, the wheel then advancing through an angle until the lever pin cooperates in abutment with the second stop member, and, when the balance pivots anti-clockwise, the impulse pin pivots the flexible lever which faces the impulse pin, moving the lifting piece thereof opposite the first stop member, and the lever pin bypassing the second stop member, the wheel rotating to the next tooth, the impulse plane imparting an impulse to the impulse pin during the movement.

3. The escape mechanism according to claim 1, wherein the lifting piece is a ruby lifting piece.

4. The escape mechanism according to claim 1, wherein the balance does not have a roller.

5. A timepiece movement including at least one of the escape mechanism according to claim 1.

6. A timepiece including at least one of the timepiece movement according to claim 1.

* * * * *